United States Patent [19]

Kondo

[11] 4,433,568

[45] Feb. 28, 1984

[54] PRECISION CLOSED-DIE FORGING METHOD

[75] Inventor: Kazuyoshi Kondo, Hamamatsu, Japan

[73] Assignee: Kabushiki Kaisha Wako, Iwata, Japan

[21] Appl. No.: 262,957

[22] Filed: May 12, 1981

[30] Foreign Application Priority Data

May 21, 1980 [JP] Japan ..... 55-66401

[51] Int. Cl.[3] ..... B21D 22/00

[52] U.S. Cl. ..... 72/356; 72/334; 72/377

[58] Field of Search ..... 72/334, 333, 338, 356, 72/377, 359; 29/159.2

[56] References Cited

U.S. PATENT DOCUMENTS 3,069,756 12/1962 Colestock ..... 29/159.2

3,298,219 1/1967 Schober ..... 29/159.2

*Primary Examiner*—Leon Gilden

*Attorney, Agent, or Firm*—Fitzpatrick, Cella, Harper & Scinto

[57] ABSTRACT

A disc-like or annular workpiece within a set of closed dies undergoes lateral flow in a first direction (e.g., radially outward or inward, depending upon the geometry of the die cavity) as the upper die is forced against the lower, with the workpiece being now restrained from flowing in other directions. Toward the end of forging, when the metal offers a rapid increase in resistance to flowing, the workpiece is set free of the restraint from flowing in a second direction, generally opposite to the first direction, as by creating a bore centrally therein or by cutting off its peripheral portion. Then, upon resumption of forging, the workpiece flows in both first and second directions, completing the desired flow in the first direction with no greater forging force than before.

15 Claims, 32 Drawing Figures

PRECISION CLOSED-DIE FORGING METHOD

BACKGROUND OF THE INVENTION

This invention relates to the art of forging in general and, in particular, to an improved method of forging with the use of closed dies. The closed-die forging method according to the invention has particular utility in forming blanks of generally disc-like or annular shape into spur gears, internal gears, etc., among other objects.

In closed-die forging, long used in industry for mass production, a metal blank is formed by compressive force into a desired shape in a closed cavity defined by a set of dies or by a mating punch and die. Such closed-die forging presents a problem, particularly in cases where the die cavity is entirely closed, as in the fabrication of gear wheels. The problem arises from the fact that the metal becomes progressively harder to flow toward the end of the forging, demanding the exertion of a correspondingly greater force Thus a tremendous forging force has heretofore been required to cause the material to finally fill up the internal space of the dies. The final forging force has been so great as to deform or, in some cases, even rupture the dies and so has seriously hampered the manufacture of gear wheels and comparable articles with precision by the closed-die forging method.

SUMMARY OF THE INVENTION

The present invention overcomes the noted problem of the prior art and provides an improved closed-die forging method whereby desired products can be formed with high precision by compressive forces that will be tolerated by the dies without the least deformation. The invention also makes possible the fabrication of spur gears, internal gears and the like in an efficient manner.

A feature of the closed-die forging method according to the invention is that, first of all, a workpiece within a set of closed dies is made to undergo lateral flowing or spreading in a first direction by a compressive force exerted between the dies, the workpiece being restrained from spreading in other directions, as has been known heretofore. Just about the time when the spreading of the workpiece in the first direction slows down, it is set free of the restraint from spreading in a second direction, which usually may be opposite to the first direction. Then a compressive force is again applied to the workpiece by the same dies as before, thereby causing its flow in both first and second directions, until the metal completes spreading in the first direction.

In order to illustrate the above summarized principle of the invention, the closed-die forging of a spur gear with the use of a disc-like workpiece will be considered. The workpiece flows or spreads in a radially outward direction during the initial forging operation, to take the internal tooth shape of the die set. Before the workpiece offers a rapid increase in resistance to outward flow, it is made free of restraint from spreading in the second direction, which in this case may be radially inward, as by forming a central bore therein. Thus the material flows both inwardly and outwardly during the secondary forging operation, completing the desired outward spreading with a much smaller forging force than heretofore.

The above and other features and advantages of this invention and the manner of attaining them will become more apparent, and the invention itself will best be understood, from the following detailed description of some illustrative examples when taken in connection with the attached drawings.

DETAILED DESCRIPTION OF THE INVENTION

The closed-die forging method of this invention will now be described in detail as adapted, first of all, for the fabrication of a spur gear, with reference directed to FIGS. 1A through 1D. The workpiece or blank W to be forged into a spur gear is of disc-like shape having a diameter approximately equal to the diameter of the dedendum circle of the desired gear. The forging apparatus comprises a lower die 10 having a cavity 11 in the shape of a spur gear, and an upper die or punch 12 toothed externally for mating engagement with the lower die.

Figure 1A:
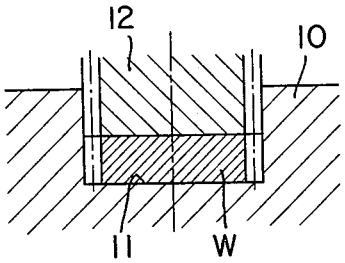
FIGS. 1A through 1D are a series of sectional views sequentially illustrating the steps of forming a spur gear by the closed-die forging method of this invention.
Figure 1B:
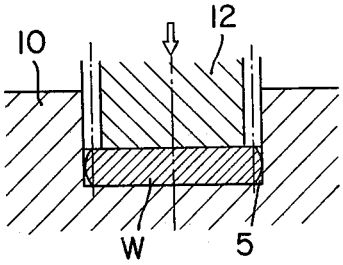
Figure 1C:
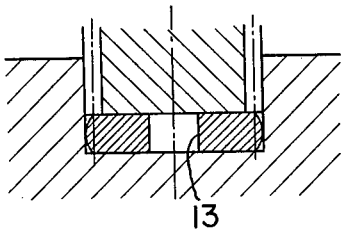

FIG. 1A shows the disc-like workpiece W placed in the die cavity 11, and the upper die 12 subsequently inserted into the die cavity. Then, as illustrated in FIG. 1B, the upper die 12 is forced down to press the workpiece W against the lower die 10 thereby causing lateral spreading of the metal in a radially outward direction. As the spreading workpiece gradually takes the gear tooth shape, the moment will come when the material offers an abrupt increase in resistance to continued spreading. Before that moment, the forging operation is suspended, and the semifinished workpiece is withdrawn from the die set. A bore of suitable size is then created centrally through the semifinished workpiece by any known or suitable method. The bored workpiece is again placed within the die set as in FIG. 1C, which shows the bore at 13, and forging is resumed.

Figure 1D:
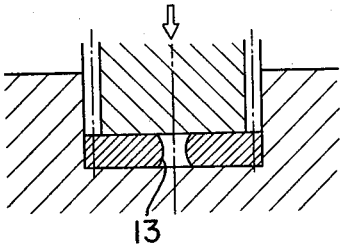

With the resumed descent of the upper die 12 the bore 13 in the workpiece permits the flow of the pressed material in a radially inward direction, so that forging will proceed with the application of substantially no greater force than before. During such progress of forging, the metal will flow not only inwardly but also outwardly, with the divide lying somewhere slightly inside the outer boundary of the workpiece. Thus, as depicted in FIG. 1D, the material will assume the exact shape of the spur gear with the exertion of much less force than has been required heretofore.

In some cases the outward flow of the material may not take place as smoothly as can be desired after the creation of the central bore 13. Then, in order to promote the outward flow, the inward flow may be restricted or retarded as by forming small projections, depressions or suitable slopes on or in either or both of the opposed pressure surfaces of the dies.

Although the bore 13 shrinks and deforms by the inward bulging of the forged material, it can be easily machined or otherwise processed into desired shape after the forging has been taken out of the dies. The method of FIGS. 1A through 1D offers the advantage of permitting the use of the conventional single-acting press, as the boring of the semifinished workpiece and the subsequent treatment of the deformed bore are carried out by external means. It will be seen that the bore may not necessarily be formed centrally through the workpiece; instead of such a bore, the openings often formed in spur gears for the purpose of weight reduction may be utilized.

In FIGS. 2A through 2D is illustrated the inventive method as adapted for the fabrication of an internal gear. The workpiece Wa in use is of annular shape, with an inner diameter slightly in excess of the diameter of the dedendum circle of the internal gear to be formed. The forging apparatus comprises a lower die **10*a* and a side die 10*a*' defining in combination an internal-gear-shaped cavity 11*a*, and an annular upper die 12*a* slidably movable into and out of the die cavity. Although the lower 10*a* and side 10*a*'** dies are shown as separate units, they could be of one piece for the purposes of the invention.

Figure 2A:
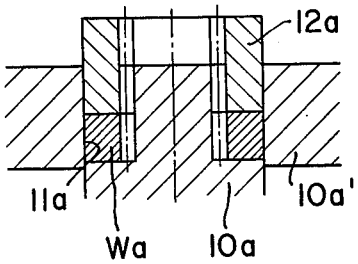
FIGS. 2A through 2D are a series of similar views explanatory of the production of an internal gear by the inventive method.
Figure 2B:
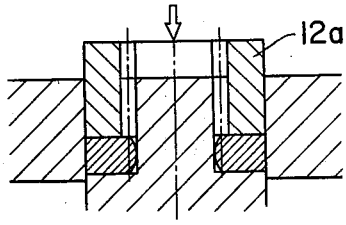
Figure 2C:
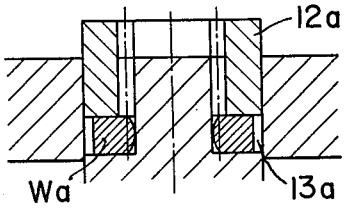
Figure 2D:
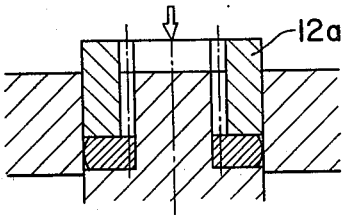

After the workpiece Wa is placed in the die cavity **11*a* as in FIG. 2A, the upper die 12*a* is forced down thereby causing spreading of the workpiece in a radially inward direction to take the internal tooth shape, as shown in FIG. 2B. The forging operation is suspended, and the semifinished workpiece withdrawn from the die set before the moment comes when an abrupt increase is encountered in the resistance of the material to further spreading. Then a peripheral portion of the semifinished workpiece is cut off, as indicated at 13*a*** in FIG. 2C, and the workpiece is replaced in the die cavity. Since now the workpiece is set free of the restraint from flow in a radially outward direction, it flows in that direction as the upper die is subsequently depressed with comparatively small force. An inward flow of the metal also takes place, so that it can be formed into the shape of an internal gear as in FIG. 2D. This method of forging internal gears also allows the use of a single-acting press. The flash at the periphery of the forging may be suitably removed by external means.

Figure 3A:
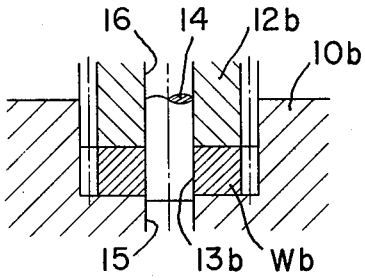
FIGS. 3A through 3D are a series of similar views explanatory of the production of a spur gear in accordance with another example of the inventive method.

FIGS. 3A through 3D represent an alternative method of forging spur gears in accordance with the invention. This alternative method differs from that of FIGS. 1A through 1D in that the disc-like workpiece Wb has a bore **13*b* preformed centrally therethrough. The forging apparatus for use with this workpiece has a mandrel 14 slidably extending through aligned bores 15 and 16 in a lower 10*b* and an upper 12*b* die. FIG. 3A indicates that when mounted in position between the dies 10*b* and 12*b*, the workpiece Wb relatively closely receives the mandrel 14 in its preformed bore 13*b*, with the mandrel slightly projecting into the bore 15 in the lower die. It is thus seen that in spite of the presence of the preformed bore 13*b*, the workpiece Wb is restrained from spreading in a radially inward direction by the mandrel 14**.

Figure 3B:
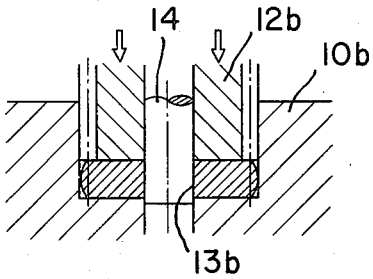
Figure 3C:
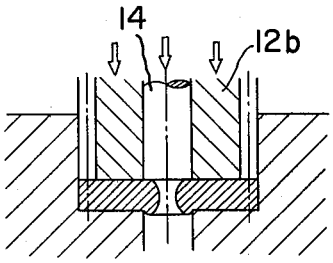
Figure 3D:
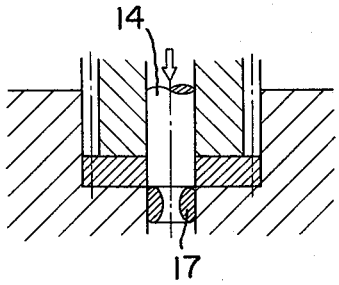

Consequently, as the upper die **12*b* is forced down as in FIG. 3B, the material flows only in a radially outward direction to start taking the gear tooth shape. The mandrel 14 is withdrawn from the bore 13*b* in the workpiece before the latter exhibits a rapid increase in resistance to outward deformation, thereby relieving the workpiece of the restraint against inward flow. The bottom end of the withdrawn mandrel 14 may be held flush with the pressure surface of the upper die 12*b* as in FIG. 3C. With the continued descent of the upper die, the metal flows both inwardly and outwardly and thus fills the gear-tooth-shaped spaces within the die set. The mandrel 14 can double as a clipping punch, for, by subsequently pressing this down, the flash at the central bore of the forging can be cut off as at 17** in FIG. 3D.

Figure 4A:
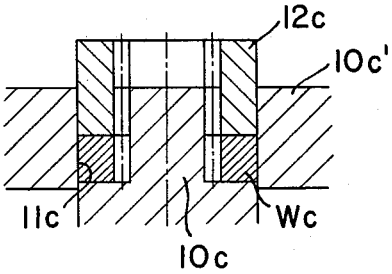
FIGS. 4A through 4D are a series of similar views explanatory of the production of an internal gear in accordance with another example of the inventive method.
Figure 4B:
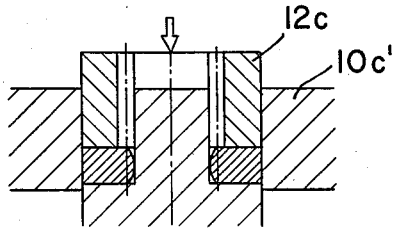

FIGS. 4A through 4D is an illustration of an alternative method of forging internal gears in accordance with the invention. This alternative method features an annular side die **10*c*' slidably fitted over a lower die 10*c* and an upper die 12*c* and coacting therewith to define a cavity 11*c* in the shape of an internal gear. The workpiece Wc for use with this method can be similar in shape to that used in the method of FIGS. 2A through 2D. With the workpiece placed in the die cavity 11*c* as in FIG. 4A, the upper die 12*c* is forced down to cause inward deformation of the material, which is now prevented from outward flow by the side die 10*c*'** being held in its normal position, as shown in FIG. 4B.

Figure 4C:
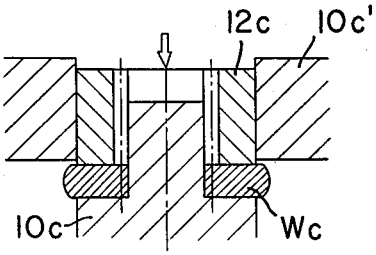
Figure 4D:
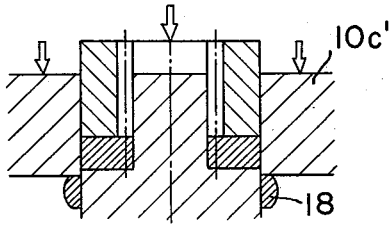

When the workpiece is about to offer an increased resistance to further inward deformation, the side die **10*c*' is relatively raised upwardly of the lower die 10*c* and upper die 12*c*, to such an extent that the workpiece becomes free to flow outwardly. FIG. 4C shows the workpiece spread both inwardly and outwardly by the subsequent descent of the upper die 12*c* relative to the lower die 10*c*. As the workpiece completes the inward flow, the side die 10*c*' may be pressed down relative to the upper and lower dies for trimming the flash 18** from the periphery of the forging, as seen in FIG. 4D.

A more efficient fabrication of external and internal spur gears is possible with the use of double-acting presses. FIGS. 5A through 5E illustrate a method of so producing external spur gears, and FIGS. 6A through 6E a method of similarly forming internal gears.

Figure 5A:
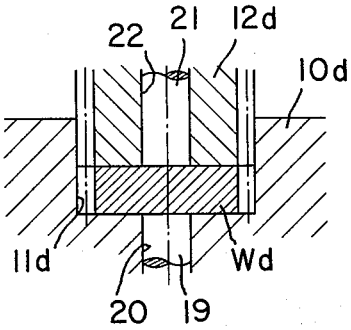
FIGS. 5A through 5E are a series of similar views explanatory of the production of a spur gear by means of a double-acting press in accordance with the invention.

As will be noted from FIG. 5A, the double-acting press for the streamlined manufacture of spur gears is similar to that of FIGS. 3A to 3D except that a rod-shaped ejector 19 is slidably fitted in a bore 20 in a lower die **10*d* having a cavity 11*d*. The ejector 19 is in coaxial register with a perforating and trimming punch 21 slidably received in a bore 22 extending centrally through an upper die 12*d*. The ejector 19 and punch 21 are of the same diameter. The workpiece Wd loaded in the die cavity 11*d*** has no such preformed bore as in the workpiece Wb of FIGS. 3A through 3D.

Figure 5B:
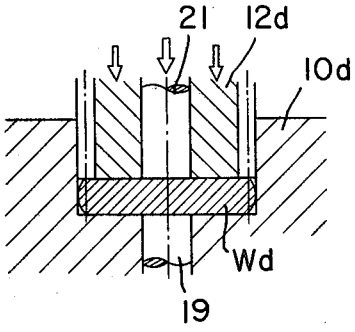
Figure 5C:
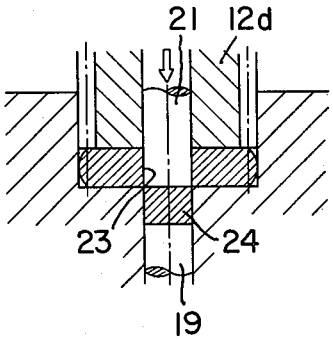

With reference to FIG. 5B the upper die **12*d* and the punch 21 are both depressed against the lower die 10*d*, with the ejector 19 locked against movement and held in contact with the bottom surface of the workpiece. Since now the ejector 19 and the punch 21 are both in fixed relation to the lower 10*d* and upper 12*d* dies, the workpiece Wd is restrained from inward flow and so spreads radially outwardly with the descent of the upper die and the punch. The upper die 12***d* is relieved of the downward force when the outward spreading of the metal slows down. Then, with the ejector 19 unlocked, only the punch 21 is pressed down to create a bore 23 centrally through the semifinished workpiece, as illustrated in FIG. 5C. The reference numeral 24 in this figure denotes the punching thus formed by the punch 21. The punch is subsequently raised to the initial position, where its bottom end is flush with the pressure surface of the upper die 12*d*.

Figure 5D:
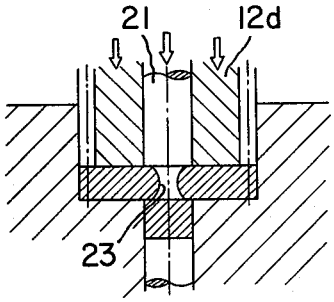
Figure 5E:
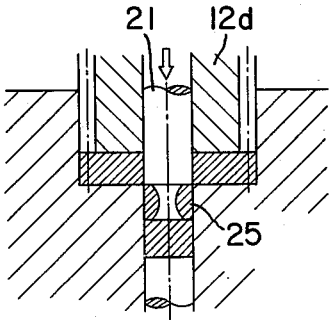

FIG. 5D shows the upper die 12*d* and punch 21 being again forced down to cause both inward and outward flow of the workpiece. If necessary, during this secondary forging operation, the punch 21 may be held slightly projecting into the bore 23 in the workpiece in order to limit the inward flow of the metal and to promote its outward flow. The flash 25, FIG. 5E, can be cut off by pressing down the punch 21 after the workpiece completes outward flow. Preferably, during such punching-off of the flash 25, the upper die 12*d* should be maintained under downward pressure. This is because the application of such compressive stress to the forged article leads to a smoother surface of the bore created by shearing. An exertion of such compressive force on the workpiece in the step of FIG. 5C is unnecessary because the bore 23 for the inward flow of the material need not have a good surface and also because the useful life of the punch will be shortened. However, in cases where the life of the punch is of no significance, the bore 23 may be perforated while the upper die is being continuously forced down. In this manner the perforated workpiece starts inward spreading immediately upon withdrawal of the punch from the bore, and the fabrication of the spur gear is completed simply as the punch makes two reciprocations, the upper die being held pressed down throughout the steps of FIGS. 5B through 5E.

Reference is now directed to FIGS. 6A through 6E in order to discuss the manufacture of internal gears with the use of a double-acting press, in accordance with the method of this invention. The double-acting press comprises a lower die 10*e* having a tubular ejector 26 slidably fitted thereover, and an upper die 12*e* of the same diameter as the lower die having a tubular clipping punch 27 slidably sleeved thereon. Also included is a side die 10*e'* encircling parts of the ejector 26 and punch 27 for relative sliding motion and defining a cavity 11*e* in combination with the other dies as well as with the ejector and punch. The annular workpiece We is placed in the die cavity 11*e* as in FIG. 6A.

Figure 6A:
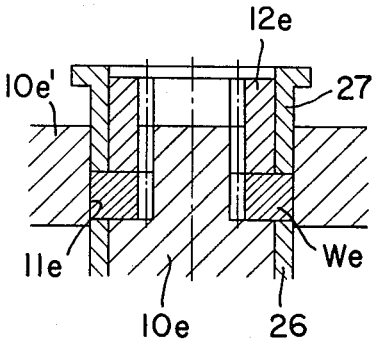
FIGS. 6A through 6E are a series of similar views explanatory of the production of an internal gear by means of a double-acting press in accordance with the invention.
Figure 6B:
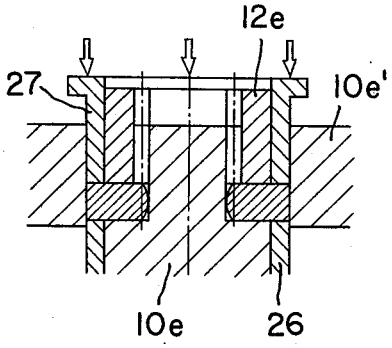
Figure 6C:
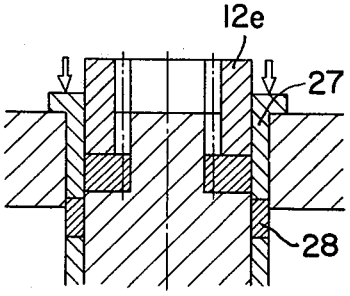
Figure 6D:
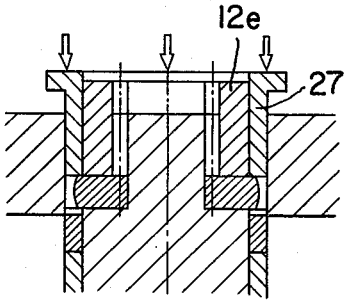
Figure 6E:
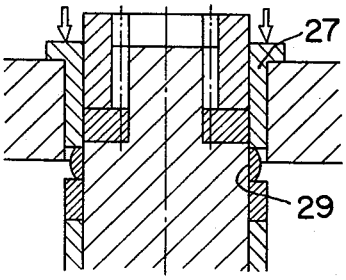

The forging of the workpiece We starts with the simultaneous descent of the upper die 12*e* and punch 27, as shown in FIG. 6B, with the ejector 26 locked against movement and with its top edge disposed flush with the pressure surface of the lower die 10*e*. Restrained from outward flow by the side die 10*e'*, the workpiece spreads inwardly, until the spreading slows down. Thereupon the application of downward force to the upper die 12*e* may be suspended, and only the punch 27 pressed down to clip a peripheral portion 28 of the semifinished workpiece as in FIG. 6C. Then, with the punch 27 raised back to the initial position, the upper die 12*e* is again pressed down together with the punch thereby causing both inward and outward flow of the metal as in FIG. 6D. Upon completion of the inward flow of the metal, the punch 27 is again forced down to trim the flash 29 from the periphery of the forging as in FIG. 6E.

A more economical use of metal being forged can be made with the double-acting press used in the method of FIGS. 5A through 5E, by operating the press in the manner illustrated in FIGS. 7A through 7F. In these figures the various parts of the press are designated by the same reference characters as used to denote the corresponding parts of the press in FIGS. 5A through 5E, and their description will be omitted, it being understood that both presses are of like configuration.

Figure 7A:
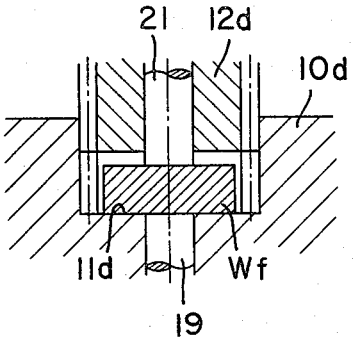
FIGS. 7A through 7F are a series of similar views explanatory of the production of a spur gear by the same press as in FIGS. 5A to 5E but through a slightly modified procedure in conformity with the inventive method.
Figure 7B:
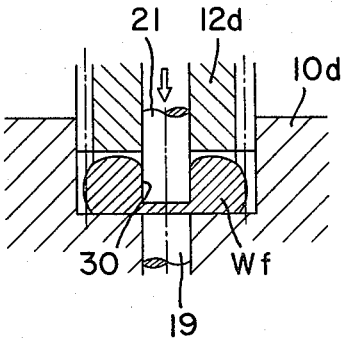
Figure 7C:
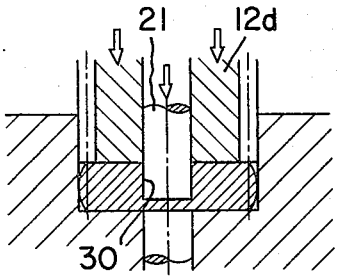
Figure 7D:
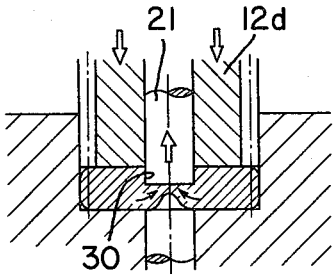
Figure 7E:
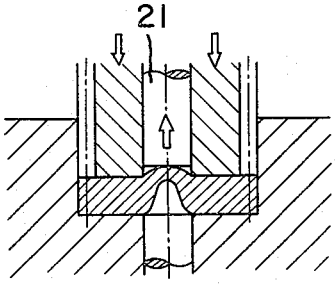
Figure 7F:
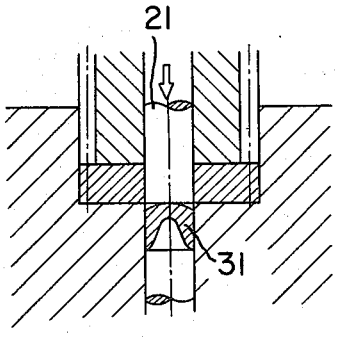

As will be noted from FIG. 7A, the disc-like workpiece Wf for use with this modified method is slightly less in diameter than the dedendum circle of the external spur gear into which it is to be forged. First, with the pressure surface of the upper die 12*d* held slightly above the workpiece Wf in the die cavity 11*d*, and with the ejector 19 locked against movement relative to the lower die 10*d*, the punch 21 is depressed to such an extent as to form a blind hole 30 centrally in the workpiece, as pictured in FIG. 7B. Thus punched, the metal spreads radially outwardly as well as upwardly. Then the upper die 12*d* is forced down as in FIG. 7C. The punch 21 is held buried in the blind hole 30 under pressure during this descent of the upper die, so that the material flows outwardly.

Approximately when the workpiece starts offering an increased resistance to the outward flow, the punch 21 is relieved of the downward pressure, whereas the upper die 12*d* continues to be forced down. Then, as indicated by the arrows in FIG. 7D, the material starts to flow inwardly thereby buckling the thin portion just under the blind hole 30 and hence causing upward displacement of the punch 21. The material also flows outwardly and acquires the correct gear tooth shape as in FIG. 7E. Then the punch 21 is forced down to remove the flash 31 from the center of the forging and thus to create a bore therein as in FIG. 7F. Compared with the procedure of FIGS. 5A to 5E, this method affords a more economical use of the metal as it does not create the punching 24 of FIG. 5C.

As will be understood from the foregoing, the successful practice of the closed-die forging method according to the invention depends upon two important factors. One is the moment when initial forging is suspended. The other is the diameter of the bore to be formed in the work, or the extent to which its outer diameter is reduced. Generally speaking, the forging forces should be approximately equal during the initial and secondary forging operations. The diameter of the bore and the extent of reduction in outer diameter both have certain tolerable ranges. If the pertinent dimension of the final product falls within those ranges, the streamlined procedures of FIGS. 5A through 5E, 6A through 6E, and 7A through 7F may be adopted. If not, then the forgings may be finished by means external to the forging press.

By way of a practical example of the inventive method, a spur gear with 22 full-depth, module-one teeth was fabricated from pure aluminum (A 1050-0). The workpiece in use was of disc-like shape, with a thickness of 5.0 mm and a diameter of 19.5 mm. If forged into the desired product by the conventional method, the workpiece would require a maximum forging force of about 30 tons. In accordance with the method of this invention the initial forging of the workpiece was suspended at 15 tons. Then a bore with a diameter of 10 mm was formed centrally through the semifinished workpiece. As the bored workpiece was put to secondary forging, only 15 tons was required to complete the forging. The face width of each tooth of the forged gear was 3.5 mm, and the diameter of the central bore was reduced to about 4.5 mm. The size of the bore could be more or less than the selected value.

On the basis of the above experimental data, spur gears each with 22 stub teeth, with a module of 1.667 and a face width of 12 mm, could be manufactured from a practical material (chromium molybdenum steel, Japan Industrial Standards designation, SCM 21) with high precision.

It should be borne in mind in carrying the inventive method into practice that a bore or similar recess to be formed in each workpiece is intended to make possible the flow of the metal in a direction or directions other than the one in which it has been spreading. Hence the bore or recess may not necessarily be formed centrally in the workpiece, and more than one such bore or recess may be created as desired or required. The size of the central bore, in particular, may be determined in consideration of that of the hole the completed product is required to have. Usually the reduced and deformed bore in the forging may be cut to the required size by opposed dies shearing process, rather than by shaving. Further, depending upon the size or shape of the desired product, the work may be bored, recessed, or reduced in diameter more than one time in order to reduce the forging force to a minimum.

Although the method of this invention has been shown and described as adapted for the production of spur gears and internal gears, it is recognized that the inventive method lends itself to adaptation for the manufacture of helical gears and a variety of other articles.

What is claimed is:

1. A closed-die forging method which comprises:
(a) placing a workpiece within a set of closed dies;
(b) forcing one of the dies against the opposed die to cause lateral flowing or spreading of the workpiece in a first direction, the workpiece being now restrained from spreading in other directions;
(c) setting the workpiece free of the restraint from spreading in a second direction, different from the first direction, approximately when the spreading of the workpiece in the first direction slows down; and
(d) again forcing one of the dies against the opposed die to cause spreading of the workpiece in both first and second directions, until the workpiece completes spreading in the first direction.

2. The method of claim 1, wherein the workpiece is of disc-like shape, wherein the first direction is radially outward, and wherein the workpiece is set free of the restraint from spreading in the second direction by creating a bore therein.

3. The method of claim 2, wherein the workpiece is withdrawn from the die set after its spreading in the outward direction in the die set in order to form the bore in the center portion thereof.

4. The method of claim 1, wherein the workpiece is of annular shape, wherein the first direction is radially inward, and wherein the workpiece is set free of the restraint from spreading in the second direction by cutting off a peripheral portion of the workpiece.

5. A closed-die forging method which comprises:
(a) providing a forging apparatus comprising upper and lower dies defining in combination a closed cavity, and a mandrel slidably mounted in the upper die;
(b) placing in the die cavity a disc-like workpiece having a bore preformed therein;
(c) inserting the mandrel into the preformed bore in the workpiece;
(d) forcing the upper die against the lower die, with the mandrel held inserted into the preformed bore in the workpiece, to cause flow or spreading of the workpiece in a radially outward direction;
(e) withdrawing the mandrel from the preformed bore in the workpiece approximately when the outward spreading of the workpiece slows down; and
(f) again forcing the upper die against the lower die to cause spreading of the workpiece in both radially outward and radially inward directions, until the workpiece completes spreading in the outward direction.

6. The method of claim 5, which further comprises punching off flash from the completed forging with the mandrel.

7. A closed-die forging method which comprises:
(a) providing a forging apparatus comprising upper, lower and side dies defining in combination a closed cavity, with the side die being slidably fitted over the upper and lower dies;
(b) placing an annular workpiece in the die cavity;
(c) forcing the upper die against the lower die to cause flow or spreading of the workpiece in a radially inward direction, the workpiece being now restrained from spreading in a radially outward direction by the side die;
(d) displacing the side die relative to the upper and lower dies to such an extent as to permit outward flow of the workpiece, approximately when the inward spreading of the workpiece slows down; and
(e) again forcing the upper die against the lower die to cause spreading of the workpiece in both radially inward and radially outward directions, until the workpiece completes spreading in the inward direction.

8. The method of claim 7, which further comprises trimming flash from the completed forging with the side die.

9. A closed-die forging method which comprises:
(a) providing a forging apparatus comprising upper and lower dies defining in combination a closed cavity, a punch slidably mounted in the upper die, and an ejector slidably mounted in the lower die and disposed in coaxial register with the punch;
(b) placing a disc-like workpiece in the die cavity;
(c) forcing the upper die against the lower die to cause flow or spreading of the workpiece in a radially outward direction, the punch and the ejector being now secured to the upper and lower dies respectively;
(d) creating a bore in the workpiece with the punch approximately when the outward spreading of the workpiece slows down; and
(e) again forcing the upper die against the lower die to cause spreading of the workpiece in both radially outward and radially inward directions, until the workpiece completes spreading in the outward direction.

10. The method of claim 9, wherein the punch is held partly projecting into the bore in the workpiece during its spreading in both outward and inward directions, in order to limit the flow of the workpiece in the inward direction and to promote flow in the outward direction.

11. The method of claim 9 or 10, which further comprises trimming flash from the completed forging with the punch.

12. A closed-die forging method which comprises:

(a) providing a forging apparatus comprising upper, lower and side dies defining in combination a closed cavity, a tubular punch slidably mounted between the upper and side dies, and a tubular ejector slidably mounted between the lower and side dies;

(b) placing an annular workpiece in the die cavity;

(c) forcing the upper die against the lower die, with the punch and the ejector secured to the upper and lower dies respectively, to cause flow or spreading of the workpiece in a radially inward direction, the workpiece being now restrained from flowing in a radially outward direction by the side die;

(d) cutting off a peripheral portion of the workpiece with the punch approximately when the inward spreading of the workpiece slows down; and (e) again forcing the upper die against the lower die to cause spreading of the workpiece in both radially inward and radially outward directions, until the workpiece completes spreading in the inward direction.

13. The method of claim 12, which further comprises trimming flash from the completed forging with the punch.

14. A closed-die forging method which comprises:

(a) providing a forging apparatus comprising upper and lower dies defining in combination a closed cavity, a punch slidably mounted in the upper die, and an ejector slidably mounted in the lower die and disposed in coaxial register with the punch;

(b) placing a disc-like workpiece in the die cavity;

(c) forcing the punch into the workpiece, with the ejector secured to the lower die, to create a blind hole in the workpiece;

(d) forcing the upper die against the lower die, with the punch held buried in the blind hole under pressure and with the ejector held secured to the lower die, to cause flow or spreading of the workpiece in a radially outward direction;

(e) relieving the punch from the pressure approximately when the outward spreading of the workpiece slows down; and (f) further forcing the upper die against the lower die to cause spreading of the workpiece in both radially outward and radially inward directions, until the workpiece completes spreading in the outward direction.

15. The method of claim 14, which further comprises trimming flash from the completed forging with the punch.

* * * * *